United States Patent [19]

Bochman, Jr.

[11] Patent Number: 4,539,872

[45] Date of Patent: Sep. 10, 1985

[54] TOOL FOR SUPPLYING AND DRIVING A SEQUENCE OF THREADED FASTENERS

[75] Inventor: Harry L. Bochman, Jr., Seal Beach, Calif.

[73] Assignee: Hi-Shear Corporation, Torrance, Calif.

[21] Appl. No.: 444,178

[22] Filed: Nov. 24, 1982

[51] Int. Cl.[3] ..... B25B 23/02

[52] U.S. Cl. ..... 81/57.37; 81/53.2; 81/57.38; 81/431

[58] Field of Search ..... 81/57.37, 431, 53.2, 81/57.38, 438

[56] References Cited

U.S. PATENT DOCUMENTS 2,105,788 1/1938 Hess ..... 81/53.2

2,806,706 9/1957 Fitch ..... 81/438

2,927,491 3/1960 Bochman ..... 81/57.37

3,157,212 11/1964 Raiteri ..... 81/431

FOREIGN PATENT DOCUMENTS 130001 3/1955 U.S.S.R. ..... 81/57.37

*Primary Examiner*—Frederick R. Schmidt

*Assistant Examiner*—J. T. Zatarga

*Attorney, Agent, or Firm*—Donald D. Mon

[57] ABSTRACT

A device adapted to be attached to a power tool comprising a reference sleeve with a telescopically received inner drive spindle which functions to admit to the work region a sequence of fasteners to feed them one-by-one, and to transmit to the lead fastener a torque so as to set the fastener.

8 Claims, 7 Drawing Figures

TOOL FOR SUPPLYING AND DRIVING A SEQUENCE OF THREADED FASTENERS

FIELD OF THE INVENTION

This invention relates to tools for supplying and driving a sequence of threaded fasteners, which fasteners may or may not have separable parts.

BACKGROUND OF THE INVENTION

Production assembly of threaded parts is facilitated by tools which apply torque to fasteners, and which also supply the fasteners. An example is the sequential setting of threaded collars to be tightened down onto a stud, a pin, or a bolt. A tool for such a purpose is shown in Bochman U.S. Pat. No. 2,927,491 issued Mar. 8, 1960. This tool has enjoyed a considerable acceptance in the trade, but accepts, and to a degree even exerts, a restraint on the design of the fastener which it drives. For example, it accepts and drives the fastener shown in George S. Wing U.S. Pat. No. 2,940,495 issued June 14, 1960. This fastener is sold by Hi-Shear Corporation of Torrance, Calif. under the trademark "Hi-Lok."

In this fastener, the driving surfaces which are engaged by the driving tool customarily have at least as large an envelope as the other sections of the fastener. This is because the walls of the driving section of the tool must both engage the driving surfaces of the fastener, and also pass the remainder of the fastener through it. This precludes having a driving section whose envelope is smaller than other portions of the fastener. As a consequence, excess material must be used to form part of the fastener, which in some fasteners is discarded anyway. When the fastener is made of expensive materials such as titanium, this constitutes a severe penalty for the use of an automatic tool.

It is an object of this invention to provide a tool which both feeds and drives a threaded fastener, and in which the surfaces used to drive the fastener can have a smaller envelope than another portion of the fastener, for example the collar which remains on the pin after driving. Then the tooling itself does not constitute a restraint on the design of the fastener.

BRIEF DESCRIPTION OF THE INVENTION

This invention constitutes a tool adapted to be attached to power means such as an air or electric motor to exert torque for the purpose of tightening down a threaded fastener. The tool comprises a reference sleeve and a drive spindle both of which are tubular constructions that are telescopically engaged. The drive spindle is inside the reference sleeve. They are relatively rotatable, and relatively axially reciprocable. Their function is to admit to the work region a sequence of fasteners, to feed them one-by-one, and to transmit to a fastener a torque so as to set the fastener.

The reference sleeve is adapted to surround the pin or bolt and rest against the adjacent work piece so as to provide a point of reference for the operation of the tool. The drive spindle is adapted to be rotated by the motor so as to transmit the setting torque to the fastener. Metering means enables the sequential one-at-a-time feeding of fasteners. Drive transmission means is adapted to be moved into driving engagement with the fastener to be driven, and to be withdrawn to permit a larger portion of the fastener to pass. The axial position of the drive spindle relative to the spindle sleeve controls said positioning of the drive transmission means.

The invention will be fully understood from the following detailed description and the accompanying drawings, in which:

DETAILED DESCRIPTION OF THE INVENTION

Figure 1:
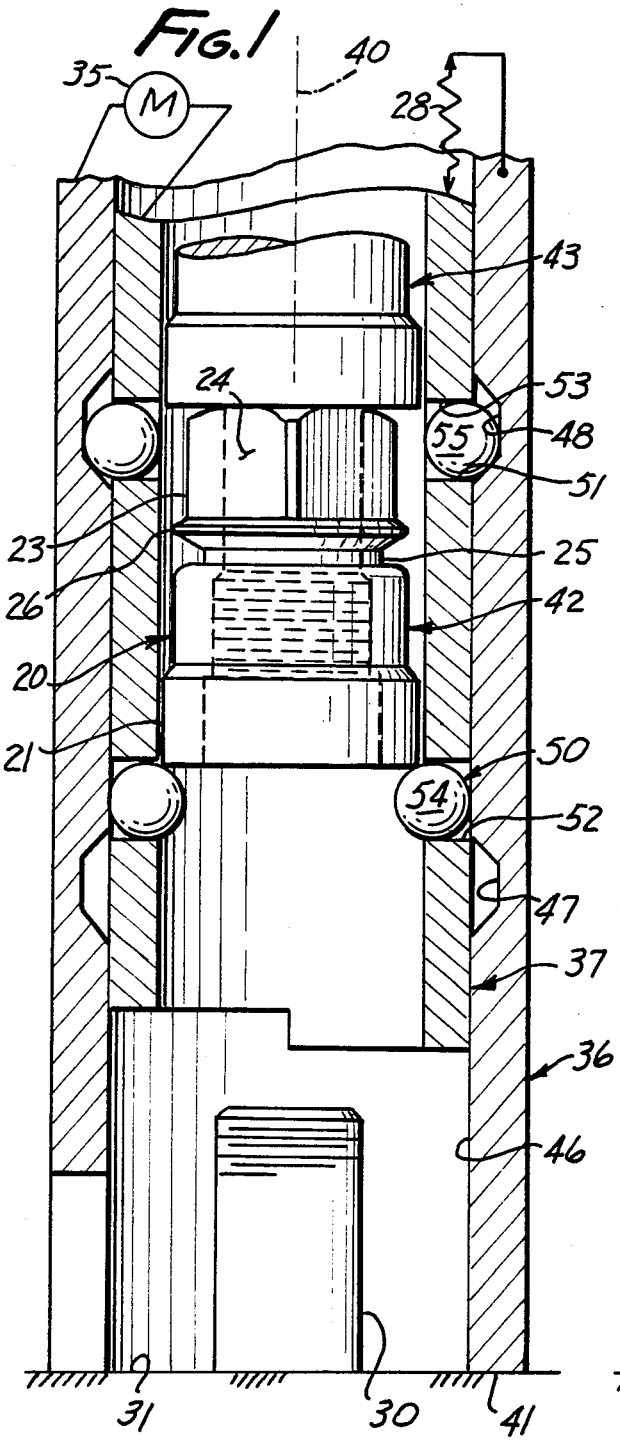
FIGS. 1, 2, and 3 are fragmentary axial cross-sections showing sequential positions of the presently preferred embodiment of the invention.

The presently preferred embodiment of the invention is adapted to drive a fastener 20 which has an internally-threaded collar section 21; a hollow, unthreaded drive section 22 with an array 23 of driving surfaces, in this case a hexagonal array of flat surfaces 24; a reduced shear section 25 of least cross-section; and a shoulder 26. The function of this fastener is similar to that shown in the aforesaid Wing U.S. Pat. No. 2,940,495 which is incorporated here in its entirety by reference. The function of this fastener is to be threaded onto a pin 30 such as a stud rising from a workpiece 31, or a bolt, or any other similar male fastener. When the collar section is threaded onto the pin and set to a desired torque by exertion of the torque force on the drive section, the fastener will fracture at its shear section 25. The shear section falls loose, and the collar section remains set on the male portion of the fastener at the desired predetermined torque. It will be observed that the envelope of the drive section 22 is smaller than the envelope of the collar section 21. In this case such an arrangement would not be acceptable for use in the fasteners driven by the driving tool shown in the said Bochman patent. Thus, with the tool of the instant invention, a smaller drive section can be provided on the fastener, and this is a significant advantage because it is to be thrown away after setting anyway, and the savings of material can constitute an important economic advantage.

It should be understood that the use of this tool is not to be limited to fasteners in which a frangible or shear section exists, part of which is to be thrown away but is also useful with any threaded fastener. However, its most important economic use is with fasteners of the class described herein.

A tool according to the invention is basically manufactured in accordance with that which is shown in Bochman Pat. No. 2,927,491 which is incorporated in its entirety to shown a meahanism suitable for driving the tool of this invention. Fasteners will be forced to the tool by compressed air to a hollow spindle which is driven by an air motor coupled thereto by a gear train. Finally, the fastener will reach a drive section which torques it.

The drive section in the Bochman tool requires that the fastener have a drive section with an envelope as large as any other section of the fastener. This invention improves the drive portion of the Bochman tool, and enables the drive section to be smaller.

As schematically shown in FIG. 1, drive motor 35 is interposed between reference sleeve 36 and drive spindle 37 so as to rotate the spindle relative to the sleeve. A bias spring 38 is interposed between the reference sleeve and the drive spindle, tending to bias the drive spindle axially away from the free end 39 of the tool. Such motor and bias spring connections are well-shown in the Bochman patent and require no detailed description here. They turn the spindle inside the sleeve around axis 40 and bias the spindle axially.

Figure 2:
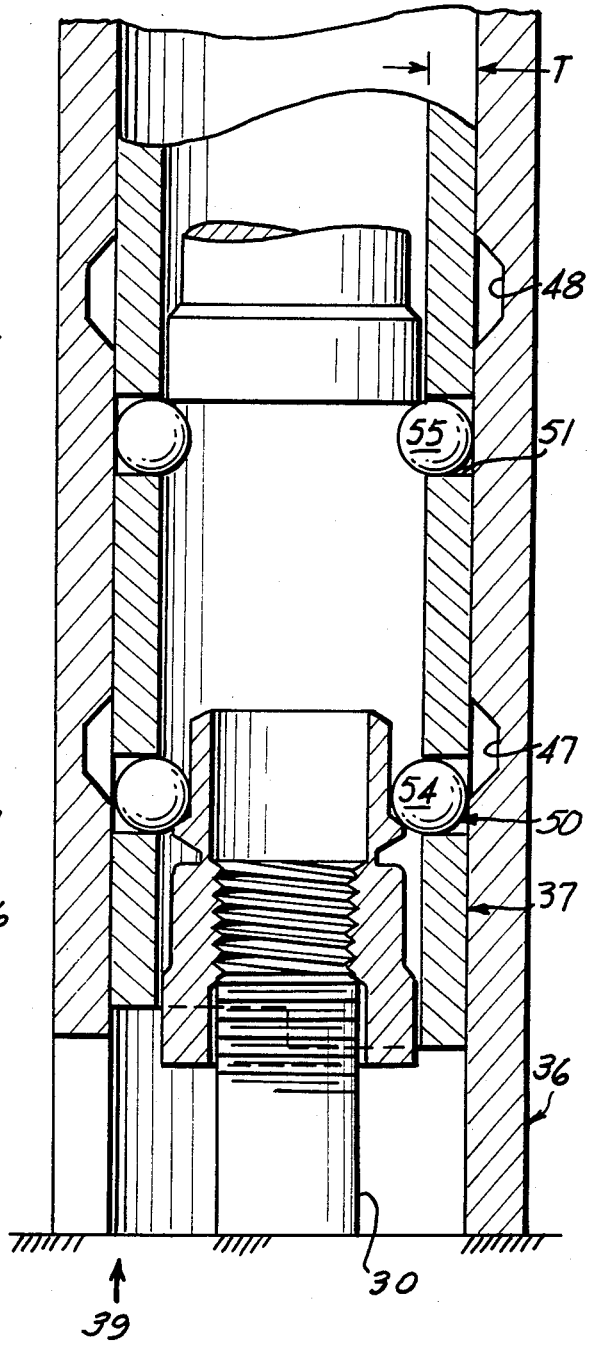
Figure 3:
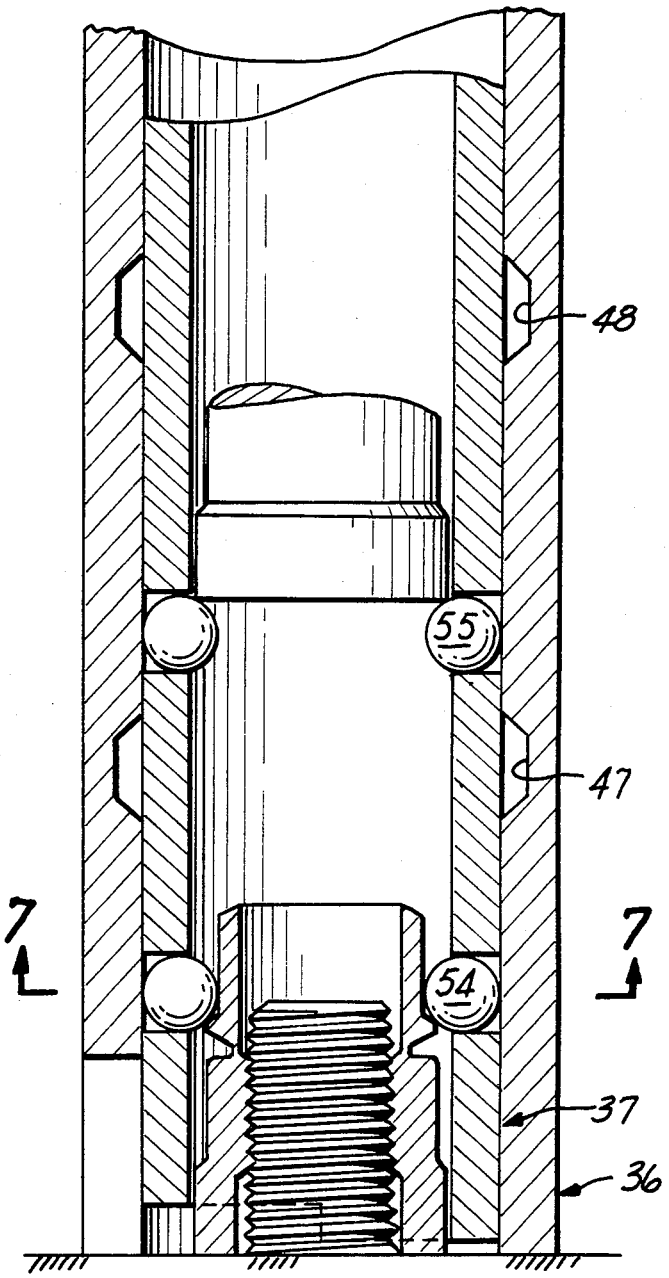

In the embodiment of FIGS. 1–3, the reference sleeve has an end 41 which is adapted to bear against the workpiece and to surround pin 30 to which a fastener is to be applied. A plurality of fasteners 42, 43 are shown which are referred to respectively as the first and the second fasteners in a sequence. For convenience, a window 44 is formed in the end of the reference sleeve, and a notch 45 is formed in the end of the drive spindle.

The reference sleeve and drive spindle make a close fit, and lubrication may be provided if desired. The reference sleeve has an inside wall 46 which is cylindrical and which has a first and a second annular relief groove 47, 48. These grooves have tapered walls to facilitate the entry and exit of balls yet to be described.

The drive spindle has a plurality of sets 50, 51 of ball-holding recesses 52, 53 respectively. Most conveniently, these can be provided in groups of three drilled holes per set. Each hole receives a respective detent ball 54, 55. It will be seen that the projection of the ball inwardly beyond the inner wall 56 of the drive spindle is a function of whether a relief groove is aligned with a ball or not. The diameter of the ball is greater than the wall thickness T of the drive spindle, whereby when it is pressed against by the inside wall of the reference sleeve it will project inwardly beyond the inside wall of the drive spindle for a purpose now to be discussed.

The fastener shown in FIG. 1 has an array of drive surfaces with an envelope which is smaller than that of the collar section or of the inner wall of the drive spindle. Also, the largest diameter of some portion of the fastener, preferably of the collar section, is large enough to overlap the detent balls when they are forced to their most inward position as a consequence of making contact with the inside wall of the reference sleeve. Furthermore, the projection of the balls inside of the inner wall of the drive spindle is sufficient that the balls can make driving contact with the drive surfaces of the array.

Also, they can roll axially along the fastener drive surfaces. In this embodiment the upper set of 51 detent balls is a metering set, and the lower set 50 is a driving set.

Figure 4:
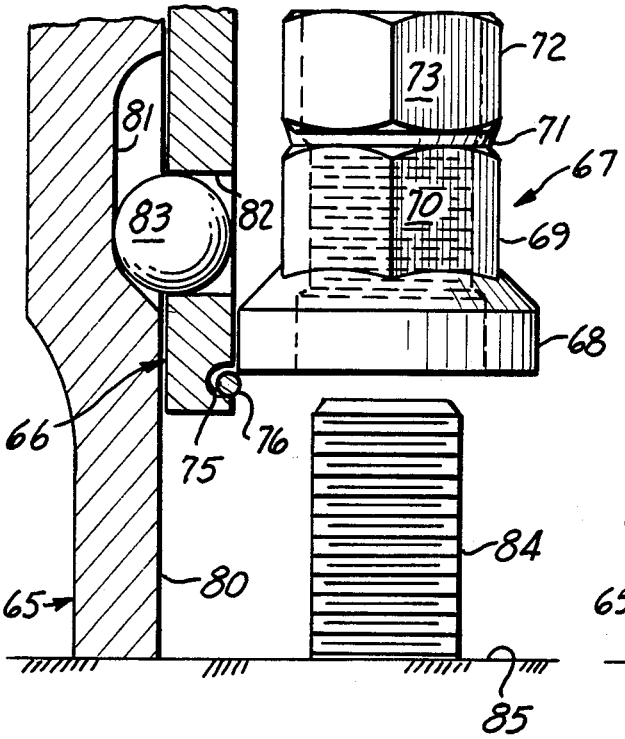
FIGS. 4, 5, and 6 are fragmentary axial cross-sections showing sequential positions of another embodiment of the invention.
Figure 5:
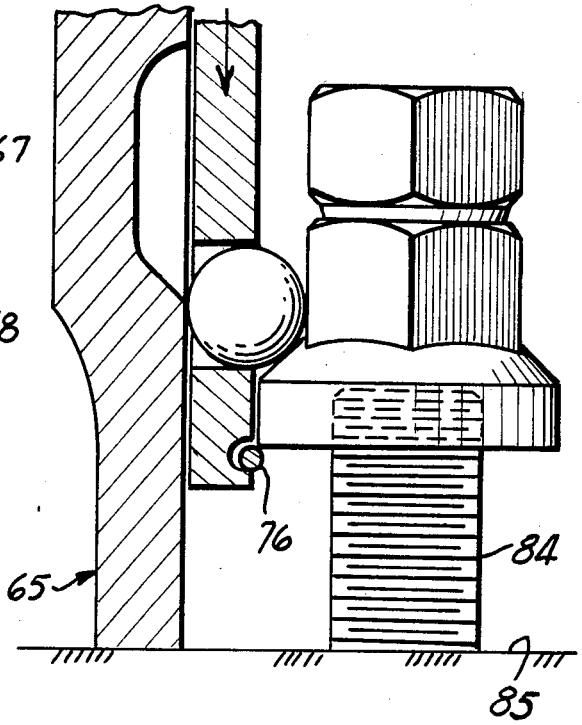
Figure 6:
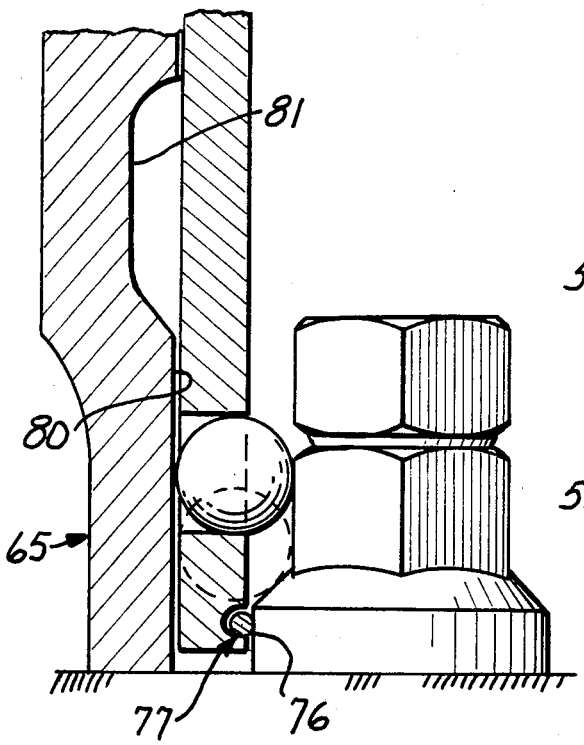
Figure 7:
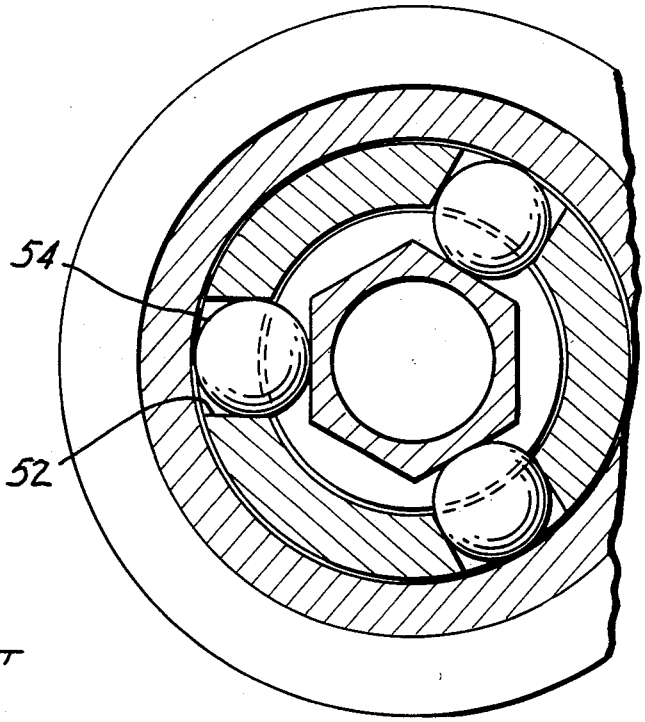
FIG. 7 is a cross-section taken at line 7—7 in FIG. 3.

The tool embodiment of FIGS. 4–6 differs from that of FIGS. 1–3 in the nature of its metering means, and in its disclosed objective of not relying upon a portion of the fastener itself to limit the torque applied to the fastener. An external reference sleeve 65 surrounds an internal drive spindle 66. These are spring biased and rotationally driven relative to one another in the manner specified in the device in FIGS. 1–3. While this embodiment can be used to drive a fastener with a shear section, it will more often be used with a fastener which does not. When this is the situation, a torque release will be provided in the tool itself, such as by a clutch, for example. The illustrated fastener 67 includes a collar section 68 and integral with it a drive section 69 with an array 70, preferably hexagonal, of drive surfaces. An optional shear section 71 is shown but need not be relied upon in the driving of this fastener. An optional secondary drive section 72 with an array 73 of drive surfaces is integral with the shear section. When the fastener is to be driven as an inherently torque limited fastener it will be driven by array 73. When it is to be driven to a torque determined by the tool itself it will be driven by forces applied to array 70. The drive spindle carries an internal peripheral groove 75 with a split ring 76 in it. The ring is inherently shaped to assume the radius shown in FIG. 4 which can be sprung apart to a larger radius or diameter as shown in FIG. 6. This constitutes a metering means 77 equivalent to the metering set 51 in FIG. 1.

The inner wall 80 of the reference sleeve has a peripheral relief groove 81 which is preferably tapered at both of its ends. A plurality of ball holding recesses 82 is formed through the wall of the drive spindle. Each of these recesses may conveniently be a drilled hole, and receives a respective detent ball 82. The ball has a diameter greater than the wall thickness of the drive spindle. It will also be noted that the envelope of the arrays on the driving surfaces on the fastener is smaller than the envelope on some other section of the fastener, in this case the threaded collar section.

A threaded pin 84 is shown projecting above the surface of a workpiece 85 in the form of a stud. It will now be understood that the split ring constitutes a metering means and the group of detent balls constitutes a driving or transmission set.

The operation of these tools should be evident from the foregoing. In FIG. 1, the start of the sequence is shown with the fasteners being fed into the driving section.

The reference sleeve has been brought against the workpiece and the bias force has caused the drive spindle to be retracted. Thus, lower balls 54 restrain the first fastener in the illustrated position. The balls in the upper set are withdrawn into groove 48, to enable the fastener to pass after some movement of the spindle.

Pressure on the tool, with the reference sleeve against the workpiece, will move the spindle to the relative condition shown in FIG. 2, wherein the balls in lower set 50 will have retracted to permit the passage of the collar section and thereafter will have been pressed inwardly against the array. This is occasioned by the fact that the lower balls will now have been moved below the lower relief groove and will have been thrust into the passage inside the drive spindle so as to engage and transmit torque to the drive section.

Meanwhile, the upper set 51 of balls will have been thrust into the inside of the drive spindle to impede the axial movement of the second fastener thereby acting as a metering means.

Continued rotation in the condition of FIG. 2 will cause driving of the first fastener and retention of the second. Ultimately, the shear section will shear and the drive section will part as shown schematically in FIG. 3. At this time, the tool will be released from the workpiece and the spring bias will cause the drive spindle to return toward the condition of FIG. 1. In so doing, the balls in the lower set will retract into the lower peripheral groove, and the balls in the upper set will retract into the upper relief groove, whereby to permit the second fastener to assume the position formerly occupied by the first fastener in FIG. 1. Sequential fasteners will follow and be treated similarly.

In the embodiment of FIG. 4, the spring bias normally holds the drive spindle at the respective axial position shown in FIG. 5, and the split ring 76, acting as metering means, retains the first fastener as shown. There is no driving force exerted because the balls are retracted. However, axial force on the drive spindle, exerted by the tool, will cam the balls inwardly so they make driving contact with the driving section of the fastener. The geometry of the system is such that threading of the fastener onto the pin can begin. The ball can roll along the drive surface, and as it does and the fastener moves along the thread, the fastener expands the split ring and can pass beyond it. When the collar section moves past the split ring, the split ring returns to a smaller radius, and impedes the next fastener.

When the fastener is set either by fracture by the shear section or by torque release within the tool, then the tool is simply backed off from the installed fastener, and the next fastener will assume its next condition of metering and driving.

The fastener can be set to a torque determined by the tool itself when an array 70 (FIG. 4) is driven which is not separated from the threaded portion of the fastener by a shear section 71. When the set of balls exemplified by ball 83 drives array 73 (FIG. 6). The torque is established by the tool. Alternatively, the elevation of the balls 83 could be raised so as to drive array 73, and the torque will be determined by the shear section. A combination may be arranged, where the fastener is first tightened down by driving on array 70, and then establishing the torque by the tool off so driving is on array 73. The spring load on the spindle will enable this backing-off to occur.

This invention thereby provides a means for driving fasteners utilizing driving contact with an array of a reduced envelope shape and size and for this purpose utilizes camming means which serve to extend the tool driving capacity inwardly toward the array. Simultaneously, metering action is exerted so that the fasteners are fed sequentially one by one.

This invention is not to be limited by the embodiments shown in the drawings and described in the description, which are given by way of example and not of limitation but only in accordance with the scope of the appended claims.

I claim:

1. A tool for driving a threaded fastener having a central axis, wherein said fastener includes an axially-extending array of driving surfaces that have a smaller envelope than the largest part of the fastener, said tool comprising: a reference sleeve having an axis, said reference sleeve having an axial cylindrical inner wall; a tubular drive spindle having an axis co-linear with the axis of the reference sleeve, and having an axial cylindrical inner wall, co-axial cylindrical outer wall, and a radially extending ball-retaining port between said walls of said drive spindle, said drive spindle being rotatably and axially reciprocably fitted in said reference sleeve; a ball in said port having a diameter greater than the wall thickness of the drive spindle; a peripheral groove formed in the inner wall of the reference sleeve, whereby, as a function of the relative axial position of the spindle and reference sleeve, the ball is either pressed inwardly inside the spindle to engage and drive said array of a fastener held co-axially in said drive spindle, or withdrawn into the groove to permit said largest part of the fastener to pass, and for said fastener to rotate freely relative to said drive spindle; and metering means axially restraining a fastener in the spindle and adapted to permit the passage of fasteners one-by-one, said reference sleeve and spindle being adapted to be mounted to a tool, said tool including power means to rotate said drive spindle around its axis.

2. A tool according to claim 1 in which a plurality of said ports and balls is provided whereby driving torque is exerted on a plurality of driving surfaces.

3. A tool according to claim 1 in which said metering means comprises a second ball-retaining port spaced axially from said first ball retaining port, and a second ball in said second port having a diameter larger than the wall thickness of said spindle, and a second peripheral groove in said inner wall of said reference sleeve spaced from said first peripheral groove, said second ball and second ball-retaining port being so disposed and arranged that they permit passage of said largest portion of said fastener after its predecessor fastener has been set.

4. A tool according to claim 3 in which a plurality of first and second ports and balls is provided.

5. A tool according to claim 1 in which said metering means comprises yieldable spring means carried by said drive spindle so disposed and arranged as to impede and yielding to permit the passage of the larger portion of said fastener through said spindle.

6. A tool according to claim 5 in which a ring groove is formed in the inner wall of said spindle, and in which said yieldable spring means comprises a split ring with a normal lateral dimension which impedes the fastener, and which can be expanded deeper into the groove to pass said fastener.

7. A tool according to claim 1 in which said drive spindle has an axial length sufficient to receive a plurality of said fasteners, and an open end to receive said fasteners.

8. A tool according to claim 3 in which said drive spindle has an axial length sufficient to receive a plurality of said fasteners, and an open end to receive said fasteners.

* * * * *